US010288073B2

(12) United States Patent
Drechsel et al.

(10) Patent No.: US 10,288,073 B2
(45) Date of Patent: May 14, 2019

(54) PUMP ARRANGEMENT

(71) Applicant: KSB Aktiengesellschaft, Frankenthal (DE)

(72) Inventors: Patrick Drechsel, Frankenthal (DE); Joerg Engelbrecht, Frankenthal (DE); Juergen Groeschel, Frankenthal (DE); Christoph Jaeger, Frankenthal (DE); Markus Lay, Frankenthal (DE); Wolfram Wetzel, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 617 days.

(21) Appl. No.: 14/889,662

(22) PCT Filed: Apr. 29, 2014

(86) PCT No.: PCT/EP2014/058706
§ 371 (c)(1),
(2) Date: Nov. 6, 2015

(87) PCT Pub. No.: WO2014/180712
PCT Pub. Date: Nov. 13, 2014

(65) Prior Publication Data

US 2016/0084256 A1 Mar. 24, 2016

(30) Foreign Application Priority Data

May 8, 2013 (DE) ..... 10 2013 007 849

(51) Int. Cl.
*F04D 13/06* (2006.01)
*F04D 13/02* (2006.01)
*F04D 29/58* (2006.01)

(52) U.S. Cl.
CPC ..... *F04D 13/0626* (2013.01); *F04D 13/024* (2013.01); *F04D 13/025* (2013.01); *F04D 29/588* (2013.01)

(58) Field of Classification Search
CPC ..... F04D 29/2255; F04D 29/225; F04D 29/2238; F04D 29/24; F04D 29/242;
(Continued)

(56) References Cited

U.S. PATENT DOCUMENTS 1,688,345 A * 10/1928 Mursch ..... F04D 29/289 415/203
2,659,312 A * 11/1953 Wahle ..... F04D 29/2238 415/106
(Continued)

FOREIGN PATENT DOCUMENTS

DE 27 54 840 A1 6/1979
DE 28 40 137 C2 4/1986
(Continued)

OTHER PUBLICATIONS

International Search Report (PCT/ISA/210) issued in PCT Application No. PCT/EP2014/058706 dated Aug. 19, 2014 with English translation (six pages).
(Continued)

*Primary Examiner* — Bryan M Lettman
(74) *Attorney, Agent, or Firm* — Crowell & Moring LLP

(57) ABSTRACT

A pump arrangement, in particular a magnetic clutch pump arrangement, includes a pump housing containing an impeller shaft, a containment shell which seals an enclosed chamber within the inner chamber of the pump housing, an impeller mounted on one end of the impeller shaft, an inner rotor mounted on the other end of the impeller shaft, an outer rotor which is mounted on the drive shaft and co-operates with the inner rotor, and an auxiliary impeller mounted in the
(Continued)

chamber adjacent to a domed base of the containment can. The auxiliary impeller is secured to the inner rotor and includes vanes and impeller channels for circulation of media.

12 Claims, 8 Drawing Sheets

(58) Field of Classification Search
CPC ..... F04D 29/245; F04D 1/14; F04D 13/025; F04D 13/024; F04D 13/026; F04D 13/027; F04D 13/021; F04D 13/0626; F04D 13/0606; F04D 29/588; F04D 29/5806; H02K 5/128; H02K 5/1282; H02K 5/1285; H02K 2005/1287; H02K 7/1085; H02K 7/11; H02K 49/10; H02K 49/104; H02K 49/106; H02K 7/003
See application file for complete search history.

(56) References Cited

U.S. PATENT DOCUMENTS 4,047,847 A * 9/1977 Oikawa ..... F04D 13/0613 417/370
4,226,574 A * 10/1980 Villette ..... F04D 7/06 310/104
4,648,808 A * 3/1987 Hauenstein ..... F04D 13/027 415/106
4,676,718 A * 6/1987 Sarvanne ..... F04D 29/2244 415/225
4,708,585 A * 11/1987 Fukazawa ..... F04D 29/225 415/218.1
4,793,777 A * 12/1988 Hauenstein ..... F04D 29/0416 417/365
4,812,108 A * 3/1989 Kotera ..... F04D 29/0413 415/111
4,850,818 A * 7/1989 Kotera ..... F04D 29/0413 416/241 A
4,998,863 A * 3/1991 Klaus ..... F04D 15/0263 417/63
5,248,245 A * 9/1993 Behnke ..... F04D 29/061 415/110
5,288,213 A * 2/1994 Nasr ..... F04D 13/026 417/368
5,302,091 A * 4/1994 Horiuchi ..... F04D 29/0413 415/111
5,441,535 A * 8/1995 Takahashi ..... F04D 29/2211 415/900
5,797,724 A * 8/1998 Liu ..... F04D 7/04 415/203
5,915,931 A * 6/1999 Lindner ..... H02K 49/106 417/420
8,025,478 B2 * 9/2011 Grimm ..... F04D 29/2288 415/204
8,128,360 B2 * 3/2012 Sensel ..... F04D 29/2244 415/203
8,439,642 B2 * 5/2013 Scott ..... F04D 7/045 415/206
2001/0043865 A1 * 11/2001 Rennett ..... F04D 29/0413 417/44.1
2001/0043871 A1 * 11/2001 Rennett ..... F04D 13/026 417/368
2006/0288560 A1 * 12/2006 Shafer ..... H02K 49/106 29/446
2010/0239417 A1 * 9/2010 Scott ..... F04D 7/04 415/203
2010/0284812 A1 * 11/2010 Zahdeh ..... F04D 29/2216 416/185
2011/0229357 A1 9/2011 Shieh et al.
2013/0115053 A1 * 5/2013 Chien ..... F04D 29/0473 415/122.1
2014/0265692 A1 9/2014 Schneider et al.

FOREIGN PATENT DOCUMENTS

DE 35 45 713 A1 6/1987
DE 42 12 982 C2 4/1996
DE 102 40 800 B4 3/2005
DE 10 2011 117 183 A1 8/2012
GB 2 009 849 A 6/1979
JP 1-315692 A 12/1989
JP 2-264193 A 10/1990
JP 2008-175090 A 7/2008

OTHER PUBLICATIONS

German-language Written Opinion (PCT/ISA/237) issued in PCT Application No. PCT/EP2014/058706 dated Aug. 19, 2014 (five pages).
German Search Report issued in corresponding German Application No. 10 2013 007849.0 dated Oct. 29, 2013 with partial English translation (10 pages).
International Preliminary Report on Patentability (PCT/IB/373) issued in PCT Application No. PCT/EP2014/058706 dated Nov. 10, 2015, including English translation of document C2 (German-language Written Opinion (PCT/ISA/237)) previously filed on Nov. 6, 2015 (six (6) pages).
English translation of Japanese-language Office Action issued in counterpart Japanese Application No. 2016-512289 dated Feb. 27, 2018 (three (3) pages).

* cited by examiner

PUMP ARRANGEMENT

CROSS REFERENCE TO RELATED APPLICATIONS

This application is a continuation of PCT International Application No. PCT/EP2014/058706, filed Apr. 29, 2014, which claims priority under 35 U.S.C. § 119 from German Patent Application No. 10 2013 007 849.0, filed May 8, 2013, the entire disclosures of which are herein expressly incorporated by reference.

BACKGROUND AND SUMMARY OF THE INVENTION

The invention relates to a pump arrangement, in particular magnetic clutch pump arrangement. The pump arrangement has an interior space formed by a pump casing a containment can which hermetically seals off a chamber surrounded by said containment can with respect to the interior space formed by the pump casing, an impeller shaft which can be driven in rotation about an axis of rotation, an impeller which is arranged on one end of the impeller shaft, an inner rotor arranged on the other end of the impeller shaft, an auxiliary impeller arranged in the chamber, and an outer rotor which interacts with the inner rotor.

German patent document no. DE 27 54 840 A1 has disclosed a magnetic clutch pump arrangement of said type with an auxiliary impeller. The auxiliary impeller is of disk-shaped construction and is equipped with radial bores. However, said embodiment, with regard to its efficiency, constitutes an inefficient impeller or delivery variant, and lowers the overall efficiency of the pump arrangement. Furthermore, a not inconsiderable level of outlay is required to produce the auxiliary impeller.

It is the object of the invention to provide a magnetic clutch pump arrangement with a forced-lubrication flow drive which is simple to produce and which exhibits improved efficiency.

The object of the invention is achieved in that the auxiliary impeller is fastened to the inner rotor.

Since the auxiliary impeller is fastened by way of its open side to that face side of the inner rotor which faces toward the base of the containment can, it is possible for the advantages of a closed channel-type impeller to be utilized by way of an open impeller, which is much easier to produce. Furthermore, the impeller does not have a hub and is easy to assemble and disassemble.

In one refinement, the containment can has a main body with an open side and with a side which is situated opposite the open side and which is closed by way of a domed base, and the auxiliary impeller has a rear shroud, whose outer surface facing toward the base of the containment can has a domed form.

By virtue of the fact that the domed form of the outer surface of the rear shroud substantially corresponds to the domed form of the base of the containment can, the dead space that is normally spanned by the domed base of the containment can is filled, whereby no additional axial structural space required by the magnetic clutch is taken up. Furthermore, the pressure resistance of the containment can is not unnecessarily reduced.

To improve the flow guidance of the medium as it enters a fluid inlet region of the auxiliary impeller, a paraboloid-like elevation is ideally provided in the center of the rear shroud.

In a further refinement, it is provided that, on the rear shroud, at a radial distance from the elevation, there are formed multiple raised portions which form vanes and corresponding impeller channels of the auxiliary impeller.

In a further refinement, it is proposed that the impeller channels have a channel base which is similar in form to a rampant three-center arch. This leads to an improvement in flow guidance.

In a further refinement of the invention, it is provided that the upper side of the vanes opposite the rear shroud, has a step close to the channel inlet edge. The step serves as an abutment shoulder and centering device for precise alignment of the auxiliary impeller fastened to the inner rotor.

For simple and inexpensive production, the impeller shaft and the inner rotor form a cover shroud, situated opposite the rear shroud, of the auxiliary impeller.

In a further advantageous refinement, in the raised portions which form the vanes, there are formed further impeller channels which extend in a radial direction from the outer lateral surface as far as a point close to the step.

To improve the flow guidance of the medium, the further impeller channels have a channel base which, at least in part, has a domed form which corresponds substantially to the domed form of the outer surface of the rear shroud.

According to the invention, the impeller shaft has an axial channel which is connected to the fluid inlet region of the auxiliary impeller.

In the context of the invention, it is proposed that, in a further embodiment, in the inner rotor, there are provided fluid channels which issue into the further impeller channels of the auxiliary impeller.

Other objects, advantages and novel features of the present invention will become apparent from the following detailed description of one or more preferred embodiments when considered in conjunction with the accompanying drawings.

DETAILED DESCRIPTION

Figure 1:
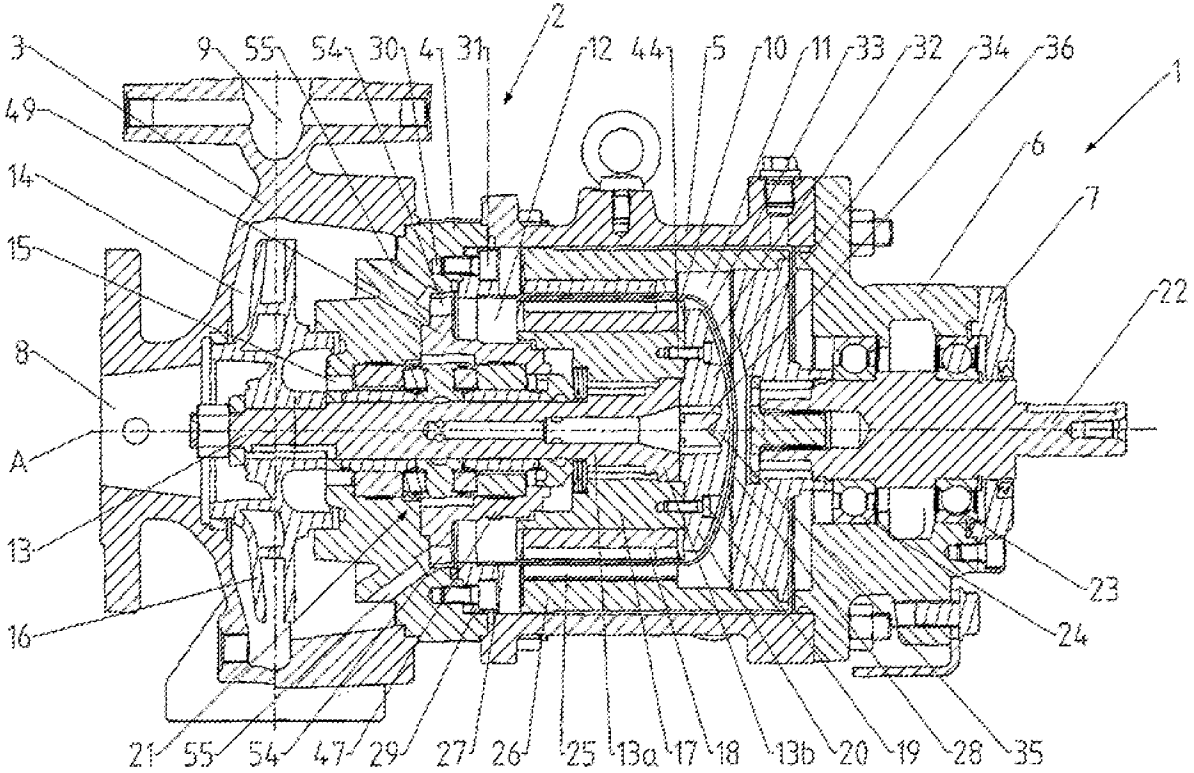
FIG. 1 shows the longitudinal section through a magnetic clutch pump arrangement having an auxiliary impeller according to an embodiment of the invention.
Figure 2:
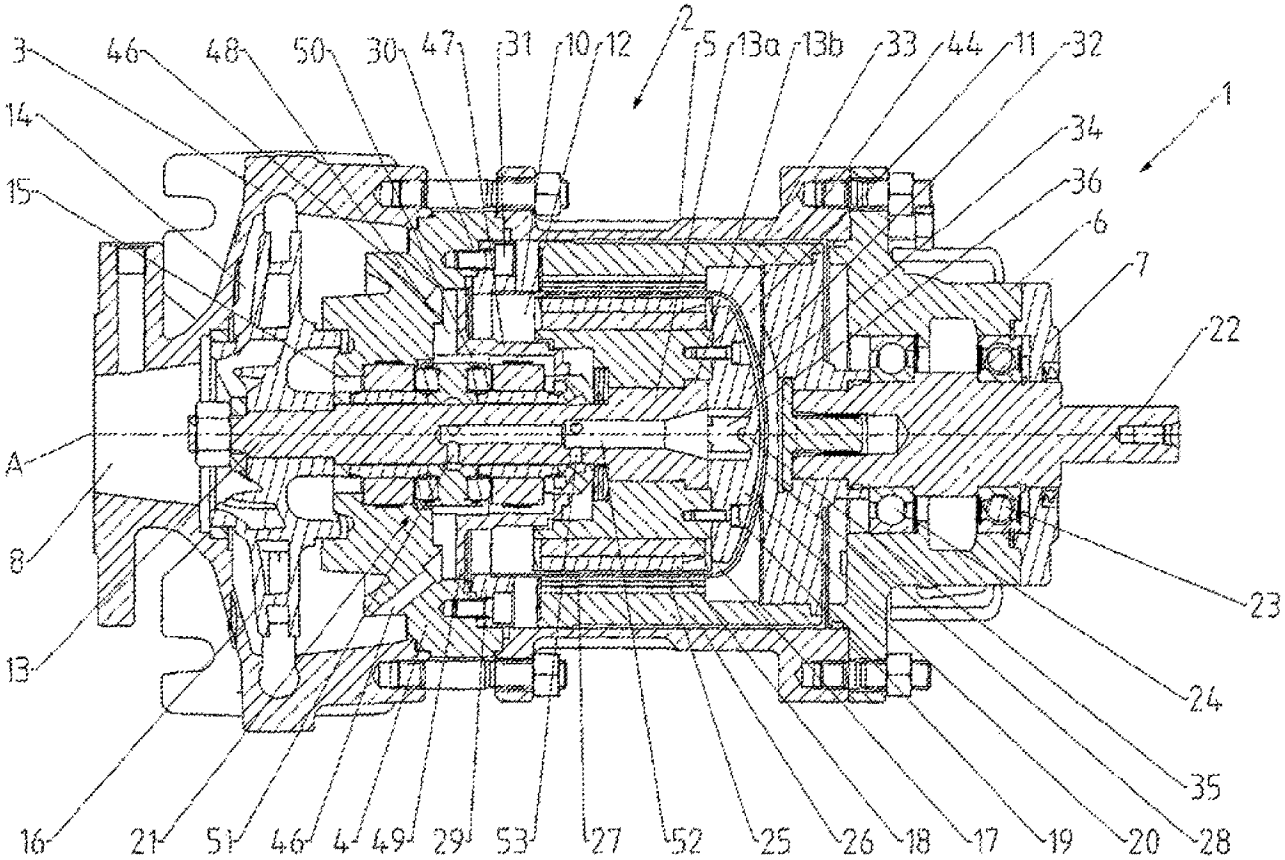
FIG. 2 shows the longitudinal section through the magnetic clutch pump arrangement as per FIG. 1 in a plane rotated through 90° in relation to FIG. 1.

FIGS. 1 and 2 show a pump arrangement 1 in the form of a magnetic clutch pump arrangement. The pump arrangement 1 has a multi-part pump casing 2 of a centrifugal pump, which pump casing comprises a hydraulic casing 3 in the form of a spiral casing, a casing cover 4, a bearing carrier cage 5, a bearing carrier 6 and a bearing cover 7.

The hydraulic casing 3 has an inlet opening 8 for the intake of a delivery medium and has an outlet opening 9 for the discharge of the delivery medium. The casing cover 4 is arranged on that side of the hydraulic casing 3 which is situated opposite the inlet opening 8. The bearing carrier cage 5 is fastened to that side of the casing cover 4 which is opposite from the hydraulic casing 3. The bearing carrier 6 is mounted on that side of the bearing carrier cage 5 which is situated opposite the casing cover 4. The bearing cover 7 in turn is fastened to that side of the bearing carrier 6 which is opposite from the bearing carrier cage 5.

A containment can 10 is fastened to that side of the casing cover 4 which is opposite from the hydraulic casing 3, and said containment can extends at least partially through an interior space 11 delimited by the pump casing 2, in particular by the casing cover 4, by the bearing carrier cage 5 and by the bearing carrier 6. The containment can 10 hermetically seals off a chamber 12, which is enclosed by said containment can and by the casing cover 4, with respect to the interior space 11.

An impeller shaft 13 which is rotatable about an axis of rotation A extends from a flow chamber 14, which is delimited by the hydraulic casing 3 and by the casing cover 4, into the chamber 12 through an opening 15 provided in the casing cover 4.

An impeller 16 is fastened to a shaft end, situated within the flow chamber 14, of the impeller shaft 13, and an inner rotor 17 arranged within the chamber 12 is arranged on the opposite shaft end, which has two shaft sections 13*a*, 13*b* with increasing diameters in each case. The inner rotor 17 is equipped with multiple magnets 18 which are arranged on that side of the inner rotor 17 which faces toward the containment can 10. An auxiliary impeller 20 is fastened to the inner rotor 17 by way of screws 19 or other suitable fastening means.

Between the impeller 16 and the inner rotor 17 there is arranged a bearing arrangement 21 which is operatively connected to the impeller shaft 13, which can be driven in rotation about the axis of rotation A.

A drive motor, preferably an electric motor, which is not illustrated drives a drive shaft 22. The drive shaft 22, which can be driven about the axis of rotation A, is arranged substantially coaxially with respect to the impeller shaft 13. The drive shaft 22 extends through the bearing cover 7, through the bearing carrier 6, and at least partially into the bearing carrier cage 5. The drive shaft 22 is mounted in two ball bearings 23, 24 which are accommodated in the bearing carrier 6. On the free end of the drive shaft 22 there is arranged an outer rotor 26, which bears multiple magnets 25. The magnets 25 are arranged on that side of the outer rotor 26 which faces toward the containment can 10. The outer rotor 26 extends at least partially over the containment can 10 and interacts with the inner rotor 17 such that the rotating outer rotor 26, by way of magnetic forces, sets the inner rotor 17 and thus likewise the impeller shaft 13 and the impeller 16 in rotation.

Figure 3:
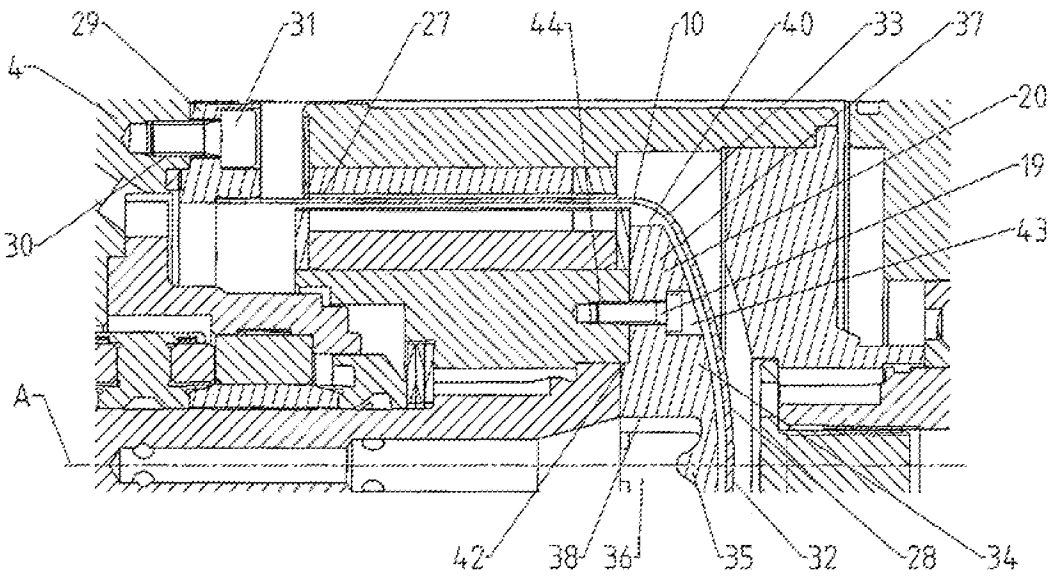
FIG. 3 shows an auxiliary impeller, corresponding to FIG. 1, in an enlarged illustration.

The containment can 10, illustrated on an enlarged scale in FIG. 3, has a substantially cylindrical main body 27. The main body 27 is open on the side facing toward the casing cover 4, and is closed by way of a domed base 28 on the side situated opposite the open side. On the open side, there is arranged a ring-like attachment flange 29 which is formed integrally with the main body 27 or which is fastened to the latter by welding or other suitable fastening means or devices, for example screws, rivets or the like. The attachment flange 29 has multiple bores 30 which extend parallel to the axis of rotation A and through which screws 31 can be passed and screwed into corresponding threaded bores in the casing cover 4. The base 28 of the containment can 10 is formed by a substantially spherical segment-shaped spherical cap region 32 and an outer rim region 33 which forms the transition region between main body 27 and spherical cap region 32.

Figure 4:
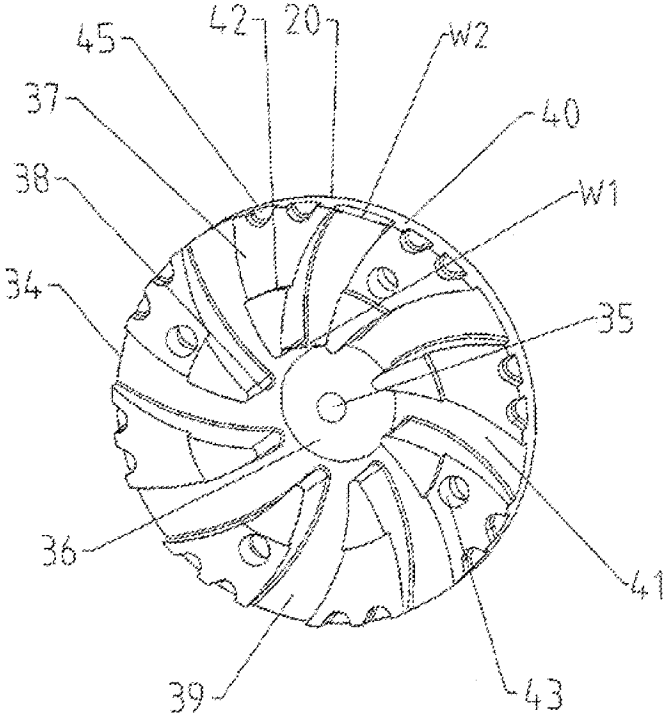
FIG. 4 is a detailed three-dimensional illustration of the auxiliary impeller as per FIG. 3.
Figure 6:
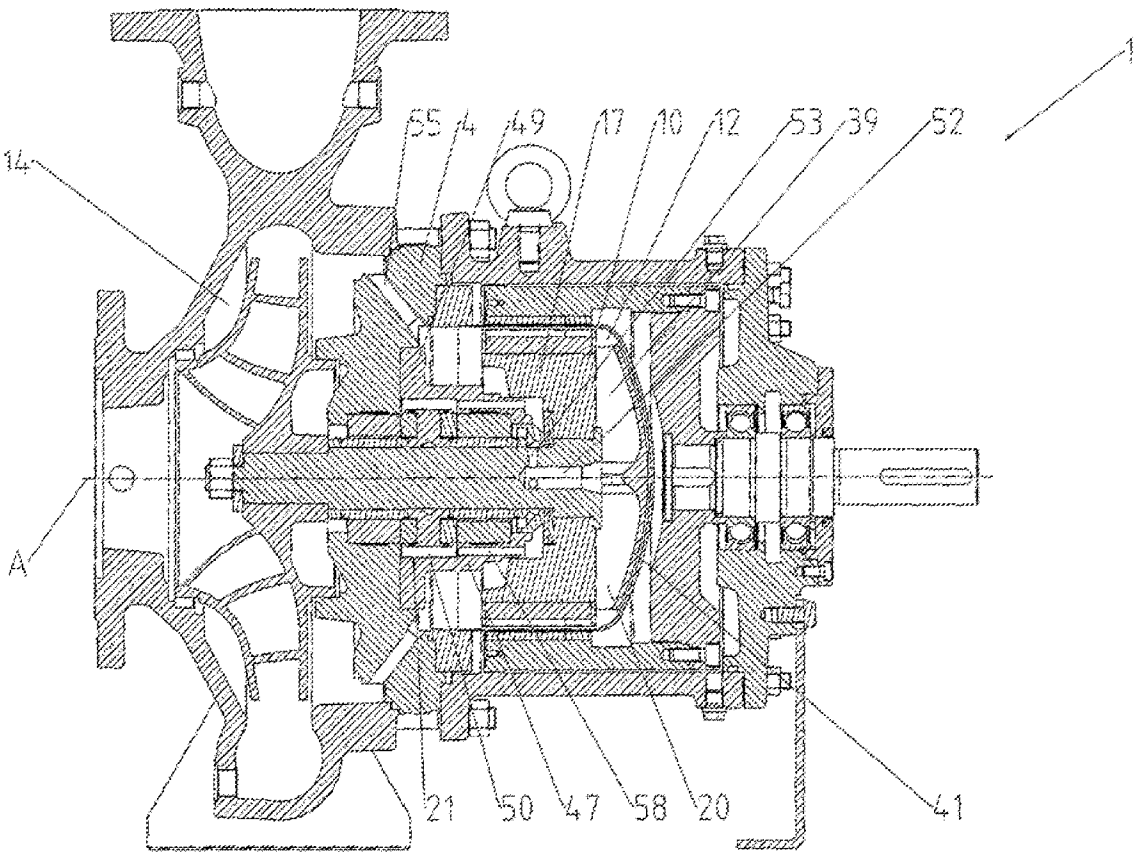
FIG. 6 shows a longitudinal section through a magnetic clutch pump arrangement having an auxiliary impeller according to the invention as per FIG. 5.

As can be seen from FIGS. 3 and 4, the auxiliary impeller 20 has a rear shroud 34, whose outer surface, facing toward the base 28 of the containment can 10, has a domed form. The domed form of the outer surface of the rear shroud 34 substantially corresponds to the domed form of the base 28 of the containment can 10. In the center of the rear shroud 34, a paraboloid-like elevation 35 is provided in a fluid inlet region 36. Furthermore, multiple raised portions are formed on the rear shroud 34 at a radial distance from the elevation 35, which raised portions form vanes 37 with a channel inlet edge 38, facing toward the elevation 35, and corresponding impeller channels 39 of the auxiliary impeller 20. The elevation 35 is conducive to improving the flow guidance of the medium as it enters the impeller channels 39 of the auxiliary impeller 20. In the exemplary embodiment shown, the vanes 37 extend in curved fashion from the fluid inlet region 36 to an outer lateral surface 40 of the auxiliary impeller 20. The impeller channels 39 have a channel base 41, which in turn has a domed form substantially corresponding to the domed form of the outer surface of the rear shroud 34. The channel base 41 of the impeller channels 39 is, in the longitudinal section shown, similar in form to a rampant three-center arch, as illustrated in FIG. 6. The impeller channels 39 have a first width W1 at the fluid inlet region 36 and have a second width W2 at the outer lateral surface 40, wherein the second width W2 is greater than the first width W1 or at least corresponds to the first width W1.

The upper side of the vanes 37 has a step 42 close to the channel inlet edge 38, which step serves as an abutment shoulder and centering device for the auxiliary impeller 20 fastened to the inner rotor 17. A cover shroud which is situated opposite the rear shroud 34 and which closes off the impeller channels 39 formed between the vanes 37 can be dispensed with, as the impeller shaft 13 and the inner rotor 17 form the cover shroud of the auxiliary impeller 20. Owing to its semi-open construction, the auxiliary impeller 20 is easy to produce both by casting, as it is easily demoldable, and by mechanical machining, as the impeller channels can be easily milled out.

At a distance radially outward from the steps 42, installation holes 43 are provided which extend through the rear shroud 34 and the vanes 37, through which installation holes the screws 19 are passed and screwed into the threaded bores 44 formed on that side of the inner rotor 17 which faces toward the base 28 of the containment can 10. The auxiliary impeller 20 can thus be fastened by way of its open side to that face side of the inner rotor 17 which faces toward the base 28 of the containment can 10. On the side situated opposite the channel inlet edge 38, each vane 37 preferably has at least one recess 45. An additional pressure increase is generated in this way.

As shown in FIG. 2, in the casing cover 4, there are provided at least one passage opening 46 and, in a bearing ring carrier 47 which fixes the bearing arrangement 21, at least one radial passage opening 48. The passage opening 48 extends through a flange-like region 49 by which the bearing ring carrier 47, which is positioned coaxially with respect to the axis of rotation A and which extends into the chamber 12, is fastened to the casing cover 4 by way of a screw connection (not illustrated). The passage openings 46 and 48 connect the flow chamber 14 to an inner region 50 of the bearing ring carrier 47.

Thus, for the cooling and lubrication of the bearing arrangement 21, delivery medium can be extracted from the flow chamber 14 and supplied by the passage openings 46 and 48 to the bearing arrangement 21. Via at least one radial bore 51, the delivery medium is delivered from the inner region 50 into an axial channel 52, which extends from a region of the impeller shaft 13 surrounded by the bearing arrangement 21 to that end of the impeller shaft 13 which is situated within the chamber 12, and thus to the auxiliary impeller 20. The axial channel 52 is thus connected to the fluid inlet region 36 of the auxiliary impeller 20. If necessary, at least one further radial bore 53 is formed which is likewise connected to the axial channel 52 formed in the impeller shaft 13. The auxiliary impeller 20 delivers the medium used for cooling and lubrication radially outward into the chamber 12, from where said medium is delivered back into the flow chamber 14 via multiple axial passage openings 54 formed in the flange-like region 49 and passage openings 55 formed in the casing cover 4, said passage openings being shown in FIG. 1.

FIGS. 5 to 8 show a further exemplary embodiment of the invention. The auxiliary impeller 20, illustrated in detail in FIG. 5, has vanes 37 which are formed by raised portions on the rear shroud 34 and which define impeller channels 39 which extend radially outward from the fluid inlet region 36. In the exemplary embodiment shown, the vanes 37 extend rectilinearly from the fluid inlet region 36 to the outer lateral surface 40 of the auxiliary impeller 20. The impeller channels 39 have a first width W1 at the fluid inlet region 36 and a second width W2 at the outer lateral surface 40, wherein the second width W2 is greater than the first width W1 or at least corresponds to the first width W1.

Figure 7:
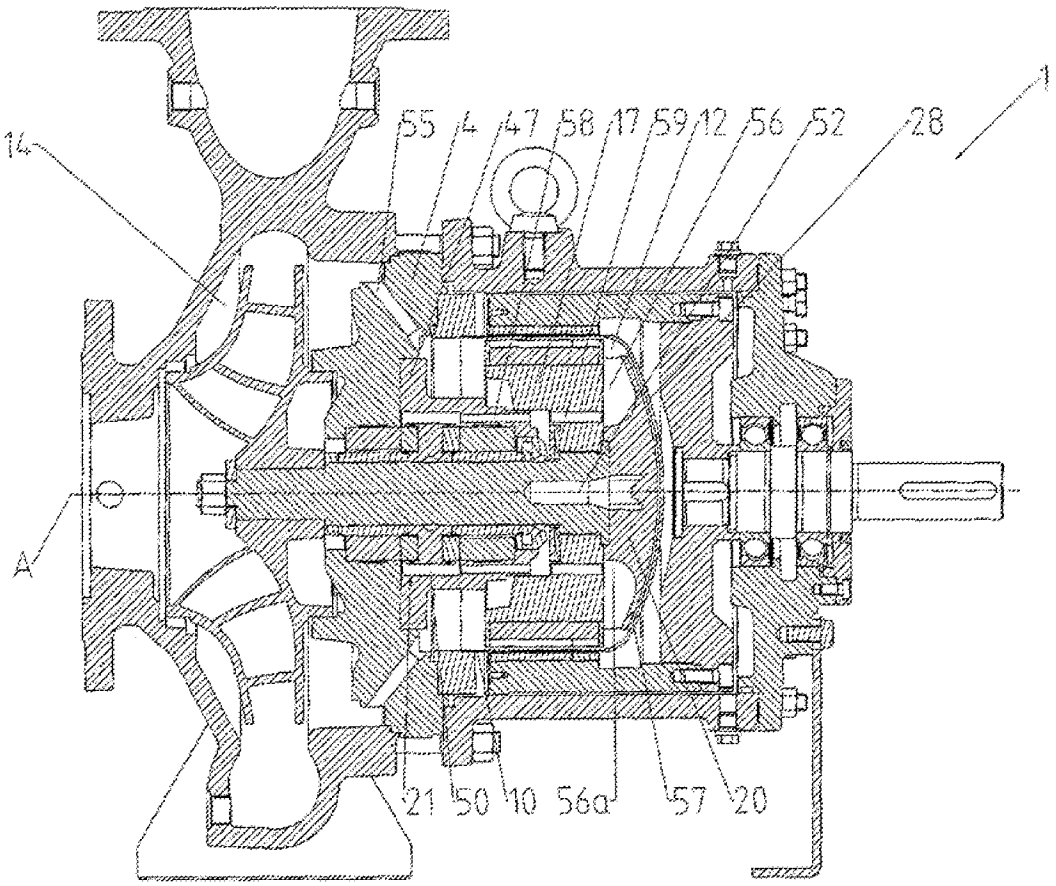
FIG. 7 shows the longitudinal section through a magnetic clutch pump arrangement as per FIG. 6, with an inner rotor rotated through 45° in relation to FIG. 6.

Further impeller channels 56 are formed in the raised portions which form the vanes 37, which further impeller channels extend in the radial direction likewise in substantially straight form, that is to say without a curvature or without a significant curvature, from the outer lateral surface 40 to a point close to the step 42, and which further impeller channels have a channel base 57 which, at least in part, has a domed form which substantially corresponds to the domed form of the outer surface of the rear shroud 34. As viewed in longitudinal section, the channel base 57 of the impeller channels 56 is similar in form to a rampant three-center arch, as illustrated in FIG. 7. The impeller channels 56 widen toward the outer lateral surface 40 proceeding from the region adjacent to the step 42, and said impeller channels have a first width W3 at a fluid inlet region 56*a* and a second width W4 at the outer lateral surface 40, wherein the second width W4 is greater than the first width W3 or at least corresponds to the first width W3.

Figure 5:
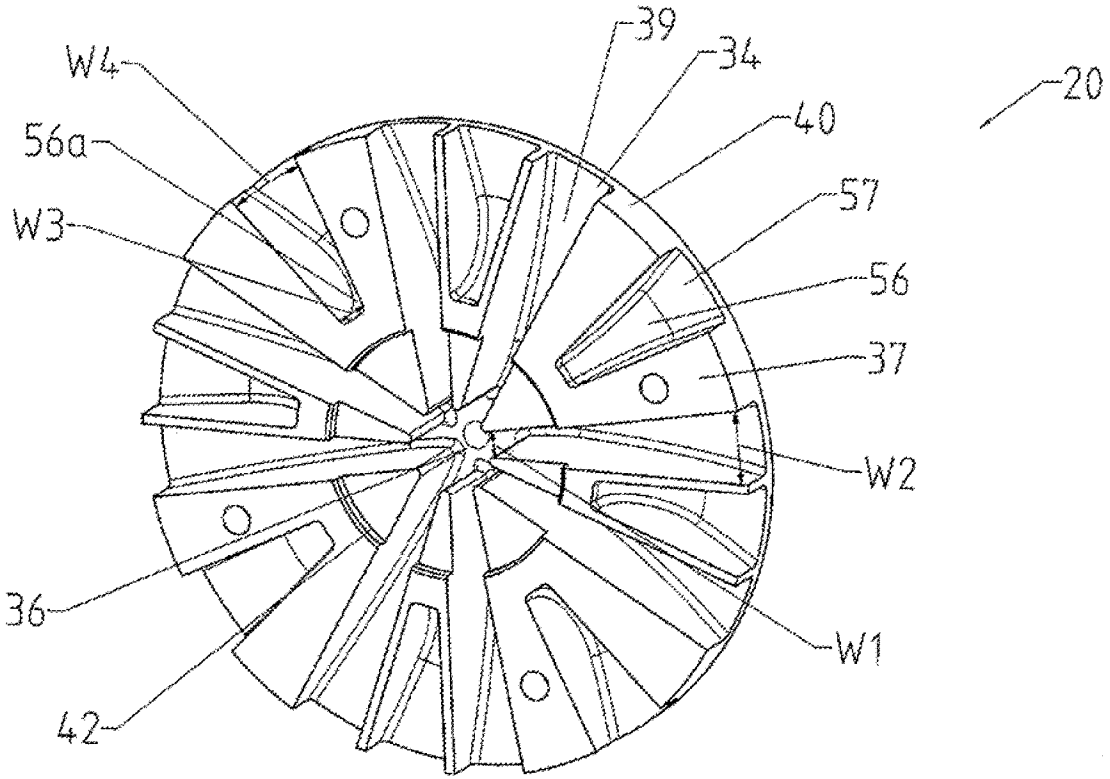
FIG. 5 is a detailed three-dimensional illustration of a further embodiment of the auxiliary impeller according to the invention.
Figure 8:
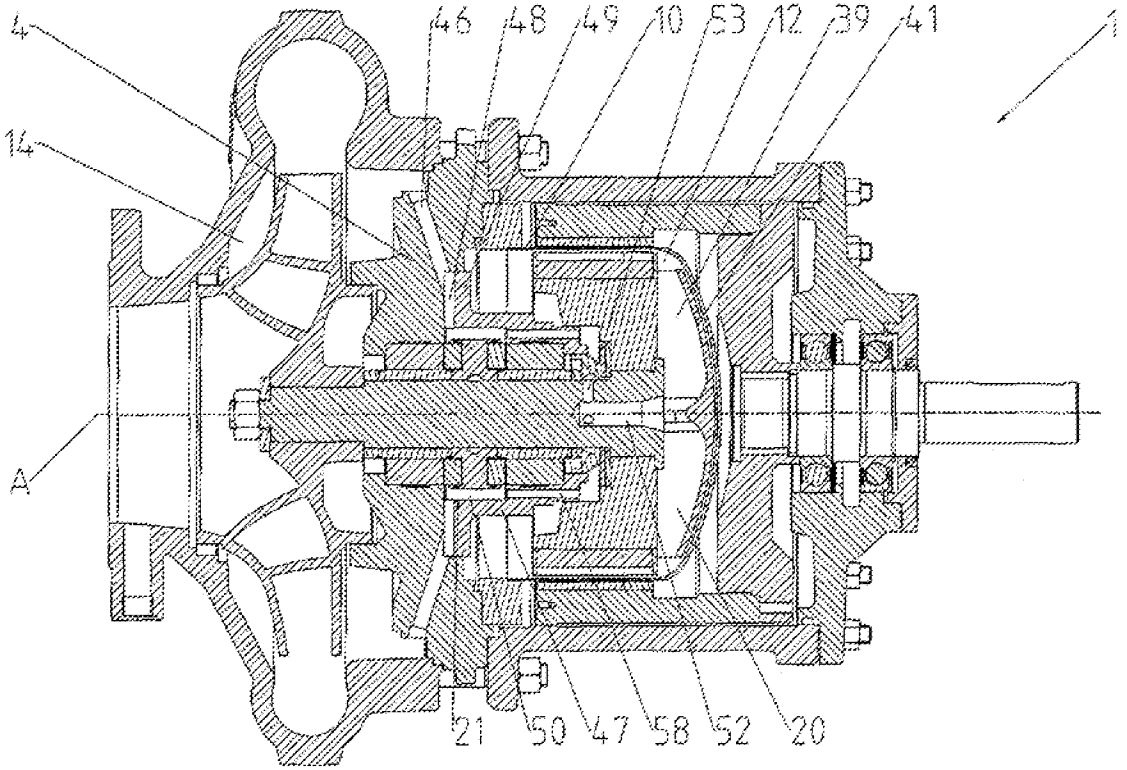
FIG. 8 shows the longitudinal section through the magnetic clutch pump arrangement as per FIG. 6, in a plane rotated through 90° in relation to FIG. 6.

FIGS. 6 to 8 show a pump arrangement 1 which is equipped with an auxiliary impeller 20 as illustrated in FIG. 5. Here, the view in FIGS. 6 and 7 corresponds to the view in FIG. 1. The view in FIG. 8 corresponds to the view in FIG. 2. As can be seen from FIG. 6, the at least one radial bore 53 leads into an axial channel 52 which is shorter than in FIGS. 1 and 2. Furthermore, the bearing ring carrier 47 has fluid channels 58 running parallel to the axis of rotation A, which fluid channels connect the inner region 50 of the bearing ring carrier 47 to the chamber 12 which is enclosed by the containment can 10 and by the casing cover 4.

FIG. 7 shows the pump arrangement 1 shown in FIG. 6 with an inner rotor 17 rotated through 45° about the axis of rotation A. In the inner rotor 17 there are provided fluid channels 59 which are arranged approximately at the same radial distance from the axis of rotation A as the fluid channels 58 of the bearing ring carrier 47, and which are thus substantially in alignment with said fluid channels 58 at least in the position illustrated. The fluid channels 59 issue into the impeller channels 56 of the auxiliary impeller 20, which is arranged on that face side of the inner rotor 17 which faces toward the base 28 of the containment can 10.

For the cooling and lubrication of the bearing arrangement 21, delivery medium is extracted from the flow chamber 14 and, as shown in FIG. 8, is supplied to the bearing arrangement 21 via the at least one passage opening 46 in the housing cover 4 and via the at least one passage opening 48 in the flange-like region 49 of the bearing ring carrier 47. Via the at least one radial bore 53, the delivery medium is delivered from the inner region 50 of the bearing ring carrier 47 into the axial channel 52 and to the auxiliary impeller 20. By way of the impeller channels 39, the auxiliary impeller 20 delivers the medium used for cooling and lubrication radially outward into the chamber 12.

At the same time, as per FIG. 7, the delivery medium extracted from the flow chamber 14 is delivered from the inner region 50 of the bearing ring carrier 47, via the fluid channels 59 formed in the inner rotor 17, into the impeller channels 56 of the auxiliary impeller 20, and radially outward into the chamber 12.

From the chamber 12, the medium is delivered back into the flow chamber 14 via the at least one passage opening 55 (shown in FIGS. 6 and 7) formed in the casing cover 4.

In the exemplary embodiments shown, the auxiliary impeller 20 is shown either with the impeller channels 39 or with the impeller channels 39 and the impeller channels 56. It is self-evident that the auxiliary impeller 20 may also be equipped only with the impeller channels 56.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE DESIGNATIONS

1 Pump arrangement
2 Pump casing
3 Hydraulic casing
4 Casing cover
5 Bearing carrier cage
6 Bearing carrier
7 Bearing cover
8 Inlet opening
9 Outlet opening
10 Containment can
11 Interior space
12 Chamber
13 Impeller shaft
13*a* Shaft section
13*b* Shaft section
14 Flow chamber
15 Opening
16 Impeller
17 Inner rotor
18 Magnet
19 Screw
20 Auxiliary impeller

21 Bearing arrangement
22 Drive shaft
23 Ball bearing
24 Ball bearing
25 Magnet
26 Outer rotor
27 Main body
28 Base
29 Attachment flange
30 Bore
31 Screw
32 Spherical cap region
33 Rim region
34 Rear shroud
35 Elevation
36 Fluid inlet region
37 Vane
38 Channel inlet edge
39 Impeller channel
40 Outer lateral surface
41 Channel base
42 Step
43 Installation hole
44 Threaded bore
45 Recess
46 Passage opening
47 Bearing ring carrier
48 Passage opening
49 Flange-like region
50 Inner region
51 Radial bore
52 Axial channel
53 Radial bore
54 Passage opening
55 Passage opening
56 Impeller channel
57 Channel base
58 Fluid channel
59 Fluid channel
A Axis of rotation

The invention claimed is:

1. A pump arrangement, comprising:

a pump casing having an interior space;

a containment can having a central longitudinal axis and being arranged to hermetically seal a chamber in the interior space;

an impeller shaft;

an impeller arranged on an impeller end of the impeller shaft;

an inner rotor arranged within the containment can on an opposite end of the impeller shaft;

an outer rotor arranged radially outside of the containment can and axially located to interact with the inner rotor, and an auxiliary impeller arranged in the chamber adjacent to a domed base of the containment can and coupled to the inner rotor, wherein the inner rotor and impeller shaft form a cover shroud for the auxiliary impeller in a manner that permits fluid flow radially outward from a center of the auxiliary impeller across a side of the auxiliary impeller facing the cover shroud.

2. The pump arrangement as claimed in claim 1, wherein the containment can has a main body with an open side and with an opposite side closed by the domed base, and the auxiliary impeller has a rear shroud having a domed-shaped outer surface facing toward the domed base.

3. The pump arrangement as claimed in claim 2, wherein a curvature of at least a radially outer portion of the dome-shaped outer surface of the rear shroud parallels a corresponding curvature of an inner surface of the domed base of the containment can which faces the rear shroud.

4. The pump arrangement as claimed in claim 2, wherein the rear shroud includes an elevation having at least one parabolic-shaped surface at a center of the rear shroud facing the inner rotor.

5. The pump arrangement as claimed in claim 4, wherein the rear shroud includes a plurality of raised vane portions with adjacent impeller channels therebetween disposed circumferentially about, and radially outward from, the elevation.

6. The pump arrangement as claimed in claim 5, wherein the impeller channels have channel bases in a form of an arch.

7. The pump arrangement as claimed in claim 5, wherein an upper side of the plurality of raised vane portions include a step adjacent to an inlet edge of the adjacent impeller channels.

8. The pump arrangement as claimed in claim 5, wherein the plurality of vanes include further impeller channels therein extending radial outward direction from an outer lateral surface of the rear shroud toward the upper side step of the plurality of vanes.

9. The pump arrangement as claimed in claim 8, wherein the further impeller channels have a channel base which, at least in a radially-outer part, is domed shaped in a manner that parallels a corresponding curvature of at least a radially outer portion of the domed-shaped outer surface of the rear shroud.

10. The pump arrangement as claimed in claim 9, wherein the impeller shaft has an axial channel connected to a fluid inlet region of the auxiliary impeller.

11. The pump arrangement as claimed in claim 10, wherein the inner rotor includes fluid channels opening into the further impeller channels of the auxiliary impeller.

12. The pump arrangement as claimed in claim 2, wherein the impeller shaft and the inner rotor cooperate to form the cover shroud opposite the rear shroud of the auxiliary impeller.

* * * * *